United States Patent [19]

Bruegge et al.

[11] Patent Number: 5,019,290

[45] Date of Patent: May 28, 1991

[54] METHOD OF FORMULATING HIGH CAUSTIC PASTE DISHWASHING COMPOSITIONS MADE COMPOSITIONS THEREBY, WHEREIN PHOSPHATE REVERSION IS MINIMIZED

[75] Inventors: Anthony J. Bruegge, Cincinnati; Denny E. Daugherty, West Chester; Terrence J. Sabatelli, Cincinnati, all of Ohio

[73] Assignee: DuBois Chemicals, inc., Cincinnati, Ohio

[21] Appl. No.: 362,561

[22] Filed: Jun. 7, 1989

Related U.S. Application Data

[62] Division of Ser. No. 171,759, Mar. 22, 1988, abandoned.

[51] Int. Cl.[5] ..... C11D 11/00; C11D 7/12; C11D 7/16; C11D 17/06

[52] U.S. Cl. ..... 252/135; 252/99; 252/103; 252/105; 252/156; 252/173; 252/174.16; 252/174.24; 252/DIG. 11; 252/DIG. 17

[58] Field of Search ..... 252/99, 103, 105, 135, 252/156, 173, 174.16, 174.24, DIG. 11, DIG. 17

[56] References Cited

U.S. PATENT DOCUMENTS

| | | | |
|---|---|---|---|
| Re. 32,763 | 10/1988 | Fernholtz et al. | 252/90 |
| 3,535,258 | 10/1970 | Sabatelli et al. | 252/105 |
| 3,886,204 | 5/1975 | Geffers et al. | 252/502.4 R |
| 4,147,650 | 4/1979 | Sabatelli et al. | 252/103 |
| 4,240,921 | 12/1980 | Kaniecki | 252/156 |
| 4,431,559 | 2/1984 | Ulrich | 252/99 |
| 4,511,487 | 4/1985 | Pruhs et al. | 252/99 |
| 4,512,908 | 4/1985 | Heile | 252/160 |
| 4,569,781 | 2/1986 | Fernholtz et al. | 252/92 |
| 4,579,676 | 4/1986 | Bull | 252/94 |
| 4,681,696 | 7/1987 | Bruegge et al. | 252/99 |
| 4,740,327 | 4/1988 | Julemont et al. | 252/103 |

OTHER PUBLICATIONS

L. R. Bacon et al.: Polyphosphate Detergents in Mechanical Dishwashing, Industrial & Engineering Chemistry, vol. 44, No. 1, 146–150.

Monsanto Phosphates for Industry, Inorganic Chemicals Division, St. Louis, Mo., 3/22/88.

*Primary Examiner*—A. Lionel Clingman

*Assistant Examiner*—A. Beadles-Hay

*Attorney, Agent, or Firm*—Wood, Herron & Evans

[57] ABSTRACT

A high caustic paste dishwashing detergent is formulated to avoid reversion of the polyphosphates. The composition which includes at least about 35% sodium hydroxide (solids) is formulated with up to 30% of a phosphate sequestering system. The phosphate sequestering system includes preferably equal proportions of tetra alkali metal pyrophosphate and alkali metal tripolyphosphate. The high percentage of pyrophosphate is added to further stabilize the phosphate system. The detergent composition also includes a low molecular weight polyacrylic acid, a phosphono alkyl tricarboxylic acid, colloidal silica and a gluconate and optionally a chlorine source and defoamer. Preferably the composition includes at least about 40% sodium hydroxide, 10% tetra sodium pyrophosphate and 10% sodium tripolyphosphate with the remainder formed from the polyacrylate, phosphono butane tricarboxylic acid, sodium gluconate, colloidal silica, Chloramine T and water.

7 Claims, No Drawings

METHOD OF FORMULATING HIGH CAUSTIC PASTE DISHWASHING COMPOSITIONS MADE COMPOSITIONS THEREBY, WHEREIN PHOSPHATE REVERSION IS MINIMIZED

This is a division of application Ser. No. 171,759, filed Mar. 22, 1988, now abandoned.

BACKGROUND OF THE INVENTION

Dishwashing machines employ a variety of different types of dishwashing detergents including liquids, powders, solid cakes of detergent and paste detergents. For example, a solid detergent is disclosed in Fernholz U.S. Pat. No. 4,469,780 and '781. Slurried dishwashing detergents are disclosed, for example, in Sabatelli U.S. Pat. No. 4,147,650, Pruhs U.S. Pat. No. 4,511,487 and Ulrich U.S. Pat. No. 4,431,559. Solid and slurried dishwashing detergents are disclosed in Bruegge U.S. Pat. No. 4,681,696.

These dishwashing detergents can include a variety of different detergent compositions. For example, the detergents disclosed in the Fernholz '780 and '781 references are high caustic detergents including close to 50% sodium hydroxide. On the other hand, the slurry dishwashing detergent disclosed in Sabatelli as well as Pruhs and Ulrich are lower caustic detergents.

All of these dishwashing detergents include hardness sequestering systems. These are chemicals which would in some way bind calcium or magnesium to prevent the deposition of the magnesium or calcium salts on the dishes being washed. There are a variety of different ones. For the prevention of calcium hardness, it is important to include a polyphosphate, generally an alkali tripolyphosphate such as sodium tripolyphosphate.

There are many different types of phosphates used to sequester hardness ions in addition to the polyphosphates, as an example tetra alkali pyrophosphate such as tetra sodium pyrophosphate. The pyrophosphates are employed preferably to combat magnesium hardness. These accomplish a different result than the polyphosphates. They are frequently combined with the polyphosphates. For example, Sabatelli U.S. Pat. No. 3,535,258 discloses a combination of pyrophosphate with tripolyphosphate in a detergent composition. However, in the preferred formulation, as well as all specific embodiments disclosed therein, only low caustic detergents are disclosed.

A variety of different phosphates are discussed in the article "Monsanto Phosphates for Industry" as well as "Polyphosphate Detergents in Mechanical Dishwashing Solubilizing Action of Polyphosphates on Certain Metals."

A problem with liquid, paste and solid (i.e., nonpowdered) detergents is reversion of the polyphosphate. Reversion is a chemical reaction of the polyphosphate to form an orthophosphate which does not effectively sequester calcium ions and reacts with calcium to form salts which deposit on the dishes. In effect, the polyphosphate is rendered useless.

This problem of reversion is not a problem with powdered detergents. If these are stored under dry conditions, there is relatively little reversion that could possibly occur. With nonpowder detergents, however, reversion is a substantial problem. The Fernholz reference discloses one method of addressing reversion, i.e., formation of a caked detergent. This apparently provides some limited benefit with respect to reversion.

The greatest problem is encountered with high caustic detergents where the detergent is stored for a long period of time. Reversion does not become a critical problem until the caustic level reaches about 25 to 35%. At high caustic levels, i.e., 40%, reversion is a critical problem. Solid paste detergents also exhibit this concern.

One additional problem encountered with paste detergents, particularly highly loaded high caustic paste detergents, is formation of a solid. These can be dispensed in a variety of different ways and in some applications it is necessary that they remain in a paste form which can flow to a certain extent. Permitting these detergents to solidify could prevent their use with certain dispensers. However, the heat generated during the mixing step tends to cause hydration which in turn causes the formation of a solid.

SUMMARY OF THE INVENTION

The present invention is premised on the realization that reversion can be substantially reduced in highly caustic phosphate detergents if the detergent is formulated as a paste. By preventing a substantial portion of the caustic from hydrating, a paste detergent is formed and reversion is minimized.

The present invention is also premised on the realization that a high caustic paste detergent composition can be formulated having more than about 30% caustic and a phosphate sequestering system where phosphate reversion is minimized. The invention is further premised on the realization that reversion of the phosphate can be minimized if the phosphate sequestering system includes approximately equi molar amounts of a tetra alkali metal pyrophosphate and an alkali metal tripolyphosphate.

Further, the present invention is premised on the realization that by properly mixing the components of the detergent composition, a highly caustic highly loaded paste detergent composition can be formed.

The objects and advantages of the present invention will be further appreciated in light of the following detailed description.

DETAILED DESCRIPTION

A highly alkali thixotropic paste detergent composition is formulated from an alkali metal hydroxide, a phosphate sequesterant system and water. In the present invention, highly caustic refers to a caustic concentration in excess of about 30% and would generally range from 35 to 45%. Paste is defined as a thixotropic composition which is not a solid at room temperature and generally a mass of semi-fluid ingredients of relatively homogeneous nature. These would generally have a viscosity of at least 30 Pa.s at 20° C. as determined with a rotational viscosimeter at a spindle speed of 5 revolutions per minute.

For use in the present invention, the alkali metal hydroxide can include either potassium hydroxide or sodium hydroxide. Due to costs, sodium hydroxide is presently preferred.

The phosphate sequesterant system will include preferably about equi molar amounts of two phosphates, a tetra alkali metal pyrophosphate and a alkali metal tripolyphosphate.

The tetra alkali metal pyrophosphates generally are not as subject to reversion and are preferably employed to sequester magnesium hardness ions. In the present formulation, they also synergistically and unexpectantly prevent reversion of the polyphosphate.

To avoid reversion of the polyphosphates, it is preferred that there be approximately equi molar amounts of pyrophosphate and polyphosphate. In a formulation, one could have an unequal amount employing either greater amounts of pyrophosphate or greater amounts of polyphosphate. If excess polyphosphate is employed, reversion of the excess would occur. However, the pyrophosphate in that instant would inhibit reversion of a portion of the polyphosphate.

The preferred pyrophosphates in the present invention is tetra sodium pyrophosphate. Likewise, the preferred polyphosphates is sodium tripolyphosphate.

The composition of the present invention should generally have the following composition in weight percent.

| | |
|---|---|
| NaOH | 30–50% |
| Tetra alkali metal pyrophosphate | 5–15% |
| Alkali metal tripolyphosphate | 5–15% |
| Alkali metal gluconate | .1–4% |
| Colloidal silica | .5–2% |
| Chlorine source | .5–2% |
| Low molecular weight polyelectrolyte (at 48% solids) .25–4.5 at 100% solids | .5–9% |
| Nitrogen free complexing agent | 0–3% |
| Defoamer | 0–4% |
| Surfactant | 0–5% |
| Water | 20–30% |

The more preferred composition includes

| | |
|---|---|
| Alkali metal hydroxide | 35–45% |
| Tetra alkali metal pyrophosphate | 7–12% |
| Alkali metal tripolyphosphate | 7–12% |
| Gluconate sequesterant | 2–4% |
| Silica | .5–2% |
| Chlorine source | 0–4% |
| Low molecular weight polyelectrolyte (at 48% solids .25–4.5 at 100% solids) | .5–9% |
| Polyvalent phosphonocarboxylic acid | 0–3% |
| Remainder water | |

The components listed above all have a synergistic effect on the paste detergent composition of the present invention.

The gluconate is employed as a builder and sequesterant. It is particularly required in this formulation to sequester hardness ions when a dilution system dispenser is employed. At this high pH, the gluconate is particularly effective. The gluconate refers to sodium and potassium gluconate, and sodium and potassium glucoheptonate. Sodium gluconate is preferred.

In addition to the gluconate, an additional sequestering agent is included, specifically a low molecular weight polyelectrolyte. Generally, low molecular weight polyelectrolytes can be employed in this invention and the preferred being polyacrylic acid. Other polyelectrolytes are disclosed in Sabatelli U.S. Pat. No. 4,147,650, the disclosure of which is incorporated herein by reference. Low molecular weight polyelectrolytes useful in the present invention generally have a molecular weight of about 1500 to about 15,000, preferably from about 4 to 12,000. These are specifically required to sequester hardness ions in high temperature applications particularly to sequester formed orthophosphates during use. The preferred polyelectrolyte is polyacrylic acid which has a molecular weight of 9–11,000 and a pH of 3.0–4.5.

The colloidal silica used in the present invention is employed to enable the composition to be as loaded as possible with detergent builders and the like and remain in a paste state. Other compositions which would be useful in addition to colloidal silica would include alumina-silica clays such as attapulgites, montmorillonite, and hectorites. The preferred colloidal silica is a hydrated silicate HiSil 233.

The composition also includes a nitrogen free sequesterant. These are required because the nitrogen containing sequesterants would react with the chlorine source. If no chlorine source is used, other sequesterants could be employed.

Nitrogen free complexing agents include polyvalent phosphonic acids such as methylene diphosphonic acid or polyvalent phosphono carboxylic acids such as 1,1-diphosphono propane-1,2-dicarboxylic acid, 1-phosphono propane, 1,2,3-tricarboxylic acid or the preferred 2-phosphono butane-2,3,4-tricarboxylic acid and their sodium and potassium salts. Thus, in a system where a chlorine source was not added, other nitrogen containing complexing agents could be employed.

The present invention further should include an active chlorine source. Active chlorine sources are disclosed in Bruegge U.S. Pat. No. 4,681,696, the disclosure of which is incorporated herein by reference. This reference discloses a combination of a sulfonamide with an active chlorine source such as a hypochlorite. However, the preferred chlorine source in the present invention is Chloramine T due to its stability. Again, the chlorine source is optional and need not be included in the present invention.

The surfactant which can be employed can be an amionic, nonionic or zwitterionic surfactant.

Preferably, the composition of the present invention will have the following formulation.

| | |
|---|---|
| 7.0% | Polyacrylic acid 8,000–12,000 molecular weight (48% solids) 3.5% on 100% solids basis |
| 2.0% | Phosphono butane tricarboxylic acid |
| 40% | Sodium hydroxide |
| 1.0% | Hydrated silicate |
| 10.0% | Tetrasodium pyrophosphate |
| 10.0% | Sodium tripolyphosphate |
| 3.0% | Sodium gluconate |
| 3.0% | Chloramine T (N-sodium-N-chloro-p-toluene sulfonamide) |
| Remainder Water | |

The paste consistency itself of the composition of the present invention assists in avoiding reversion of the phosphates even without the pyrophosphate. However, with highly caustic detergent compositions, there is a tendency for the composition to become fully hydrated during mixing and form a solid composition. Accordingly, during mixing the temperature is maintained low enough to substantially reduce the amount of hydration of the sodium hydroxide and thus avoid formation of a solid composition.

In order to achieve this, the temperature is maintained at less than 130° F. and preferably less than 120° F. while a substantial portion of the sodium hydroxide is added to the composition.

The polyelectrolyte is generally acidic as well as the phosphono carboxylic acid. These are neutralized initially with a liquid solution of sodium hydroxide. During this neutralization, the temperature may exceed 130° F. However, as long as only a minor portion of the sodium hydroxide is added while the temperature is in excess of 130° F., the ultimate detergent composition will maintain a paste form. Basically, only as much NaOH as is required to neutralize the acid components of the detergent formulation should be added while the temperature exceeds 130° F. After neutralization, the temperature is reduced to about 120° F. and the mixing continues.

Generally, it is undesirable to add more than about 10–20% sodium hydroxide at temperature in excess of 130° F. If a substantial portion of other hydratable detergents is added to the composition, even less sodium hydroxide can be added while the temperature is in excess of 130° F.

However, generally with compositions that have in excess of 35% caustic, it is undesirable to add more than 20% of that amount (i.e., 7%) at any temperature higher than 130° F.

The following mixing procedure is suggested for the preferred formulation. The percentages of the different chemicals added is in parenthesis. These percentages relate to the total detergent composition by weight including water. The polyacrylic acid (7%) is combined with deionized water (3%) and phosphono butane tricarboxylic acid (2%). Aqueous sodium hydroxide which is 49% NaOH (41%) is slowly added with mixing and cooling to neutralize the PAA and tricarboxylic acid. The temperature is maintained at less than 130° F. This is mixed for 15 minutes and cooled during the entire addition. Sodium gluconate is added (3%) immediately after the sodium hydroxide liquid. When the temperature is less than 130° F., sodium hydroxide beads (20%) are slowly added. This is mixed for 15 minutes with continued mixing as the hydrated silicate (1%) is added. The temperature is cooled and maintained at 120° F. and the tetrasodium pyrophosphate is added (10%) along with the sodium tripolyphosphate (10%). Finally, the Chloramine T (3%) is added and mixed for 15 minutes. This is immediately taken out of the mixer and stored in containers.

The order of addition requires that the composition begin with the acidic component followed by the liquid sodium hydroxide. The neutralization and cooling permits the remainder of the NaOH to be added at a lower temperature. It is important that after the sodium hydroxide is added, the silicate be added with cooling and mixing. Finally, the phosphate sequesterant system and the Chloramine T can be added again with cooling. Adding the phosphates prior to addition of the silicate would cause a gellation of the product which could not be reversed. Once one-fourth of the liquid NaOH (8.0% solid) has been added, the temperature must not exceed 130° F. or a solid will form and yield more orthophosphate.

This order of addition and careful control of temperature maintains a portion of the sodium hydroxide in a nonhydrated form. This portion is in an amount effective to prevent formation of a solid detergent. Depending on the amount of builders, the relative amount of this portion will vary, but this can be easily determined empirically. Generally this paste detergent will include about 10% tripolyphosphate and at least 20% total hydratable detergent builders (excluding caustic).

Formation of a paste detergent by preventing most of the caustic from hydrating, substantially reduces reverion of polyphosphates even without the addition of the pyrophosphates. The addition of an equi molar amount of pyrophosphate reduces reversion even more. Thus, the paste detergent composition of the present invention is useful in typical industrial dishwashing equipment.

The preceding has been a description of how to practice the invention along with the best mode of practicing the invention known to the inventors at this time.

However, we intend to be bound by our claims wherein we claim:

1. A method of formulating a paste detergent composition having from about 35% to about 50% NaOH, water and at least about 20% hydratable detergent builders including at least 10% phosphate sequesterant based on the total weight of the composition said method comprising mixing the NaOH, water and builders and maintaining an effective portion of said NaOH at less than 130° F. at all times during mixing to thereby prevent hydration of said portion of NaOH thereby maintaining said detergent as a paste to avoid reversion of said phosphate sequesterant.

2. The method claimed in claim 1 having at least about 30% phosphate sequesterant.

3. The method claimed in claim 1 wherein said detergent comprises at least about 40% NaOH and wherein three-fourths of said NaOH is maintained at less than 120° F. during mixing.

4. The method claimed in claim 1 wherein said composition includes acidic components selected from the group consisting of phosphono carboxylic acid and acidic polyelectrolytes said method further comprising first neutralizing said acidic components with a first amount of NaOH and adding a remaining portion of NaOH only while said temperature is less than 130° F. wherein said first portion comprises less than 25% of said NaOH added.

5. The method claimed in claim 1 wherein at least 80% of said NaOH is maintained at less than 130° F. at all times during mixing.

6. A method of forming a paste detergent having from about 35% to about 50% sodium hydroxide, at least 10% of a phosphate sequestering system, additional detergent builders and 20–30% water said method comprising;

forming a detergent mixture by mixing a first portion of said sodium hydroxide comprising up to about 25% of said sodium hydroxide, said phosphate sequesterant system and said additional detergent builder with said water;

cooling said mixture to less than 130° F. as a second portion of said NaOH is added thereby preventing hydration of said second portion of NaOH and thereby preventing said detergent from solidifying.

7. A high caustic paste detergent composition comprising 35 to 50% sodium hydroxide and at least 10% alkali metal tripolyphosphate wherein a portion of said sodium hydroxide is a nonhydrated portion and is an amount effective to prevent formation of a solid detergent and maintain said detergent as a paste.

* * * * *